United States Patent [19]

Aldag et al.

[11] 4,201,021

[45] May 6, 1980

[54] BUILDING FRAME CONSTRUCTION

[75] Inventors: John Aldag, Chicago, Ill.; Willis L. Wells, Clayton, Mo.

[73] Assignee: Bantam Systems, Inc., Chicago, Ill.

[21] Appl. No.: 903,752

[22] Filed: May 8, 1978

[51] Int. Cl.[2] ..... E04B 7/02; E04C 3/08; E04C 3/11

[52] U.S. Cl. ..... 52/93; 52/639; 52/693

[58] Field of Search ..... 52/93, 90, 639, 643, 52/693, 478; 403/400

[56] References Cited

U.S. PATENT DOCUMENTS

| | | | |
|---|---|---|---|
| 1,336,324 | 4/1920 | Waern | 52/639 |
| 2,864,471 | 12/1958 | Williams | 52/693 X |
| 2,871,997 | 2/1959 | Simpson et al. | 52/93 |
| 3,474,578 | 10/1969 | Wippermann | 52/694 X |

FOREIGN PATENT DOCUMENTS

| | | | |
|---|---|---|---|
| 806726 | 6/1951 | Fed. Rep. of Germany | 52/90 |
| 16127 | of 1894 | United Kingdom | 52/93 |
| 542229 | 12/1941 | United Kingdom | 52/90 |

*Primary Examiner*—Alfred C. Perham
*Attorney, Agent, or Firm*—Kinzer, Plyer, Dorn & McEachran

[57] ABSTRACT

A building frame construction for a light metal building. The frame utilizes a series of transverse sub-frame assemblies forming side wall columns and main roof beams. Purlins and girts extend longitudinally between and are attached to the sub-frames to provide support for the side wall and rool panels; end wall columns and girts are provided to support the end wall covering. Each sub-frame comprises a plurality of modular truss units which are interconnected to form the unitary assembly of the sub-frame. Each truss unit comprises two main beams interconnected by struts and braces; the main beams are each formed from two angles aligned in a facing relation with a slot down the middle to permit attachment of any number of purlins or girts at any point along the beam.

4 Claims, 14 Drawing Figures

BUILDING FRAME CONSTRUCTION

BACKGROUND OF THE INVENTION

This invention relates to construction of light metal buildings and particularly to a frame construction particularly suitable for buildings for farm and rural use. In the past this market has not been supplied with an economical, readily available structure. This has largely been due to inability of centralized manufacturing operations to supply the inherently diffuse rural market. Use of multiple plant locations has not been an effective solution because any single plant does not have a large enough market share to support the facilities required.

Consequently, the tendency has been to build large rigid structures at central locations and ship them to the immediately surrounding area. Areas remote from manufacturing centers are likely to be unable to obtain these metal buildings. Prior structures have tended to be unduly expensive due to high shipping costs, high construction costs based partly upon the heavy equipment necessary to erect the structures, and the costs of the substantial foundations needed to support the buildings. Moreover, prior structures have usually been designed for maximum load requirements, thus precluding the cost savings that might be attained where less sturdy structures will suffice.

SUMMARY OF THE INVENTION

A primary object of this invention is to provide a new and improved metal building frame construction which can be adapted for use in a variety of light metal building applications.

Another object is the design of a metal building truss construction which allows for a substantial reduction in steel weight without loss of structural integrity.

Another object is to provide a metal building frame construction which has practically zero outward thrust at the foot so that simple pier foundations can support the building.

Another object is to provide a metal building frame construction which allows for selective purlin and girt spacing, varying wind and snow load capacity to suit local requirements.

Another object of the invention is to provide a new and improved metal building frame construction which can be fabricated in light-weight modular units that can be handled and erected without heavy machinery or specialized tools.

Accordingly, this invention is directed to a building frame construction for a light steel building comprising a plurality of transverse sub-frames. Each sub-frame is a unitary assembly comprised of a plurality of interconnected modular truss units. The sub-frames form both the side wall columns and main roof beams. Purlins and girts extending between the sub-frames, with the purlins attached to the roof beams and the girts attached to the side wall columns, complete the basic frame structure. End wall columns and transverse girts attached to the end wall columns complete the building frame.

Each truss unit is made up of two main beams, an inside beam and an outside beam; the beams are interconnected by a plurality of strut and brace members. Each outside main beam comprises a pair of angle members having integrally formed flanges extending at substantially ninety degrees. The pair of angle members is aligned so that the flanges are in facing relation but are separated by a space to form a slot between the angles.

The slot runs the length of the beam to provide for attachment of purlins or girts at any desired position along the beam.

DESCRIPTION OF THE PREFERRED EMBODIMENT

Figures 1, 8, 9:
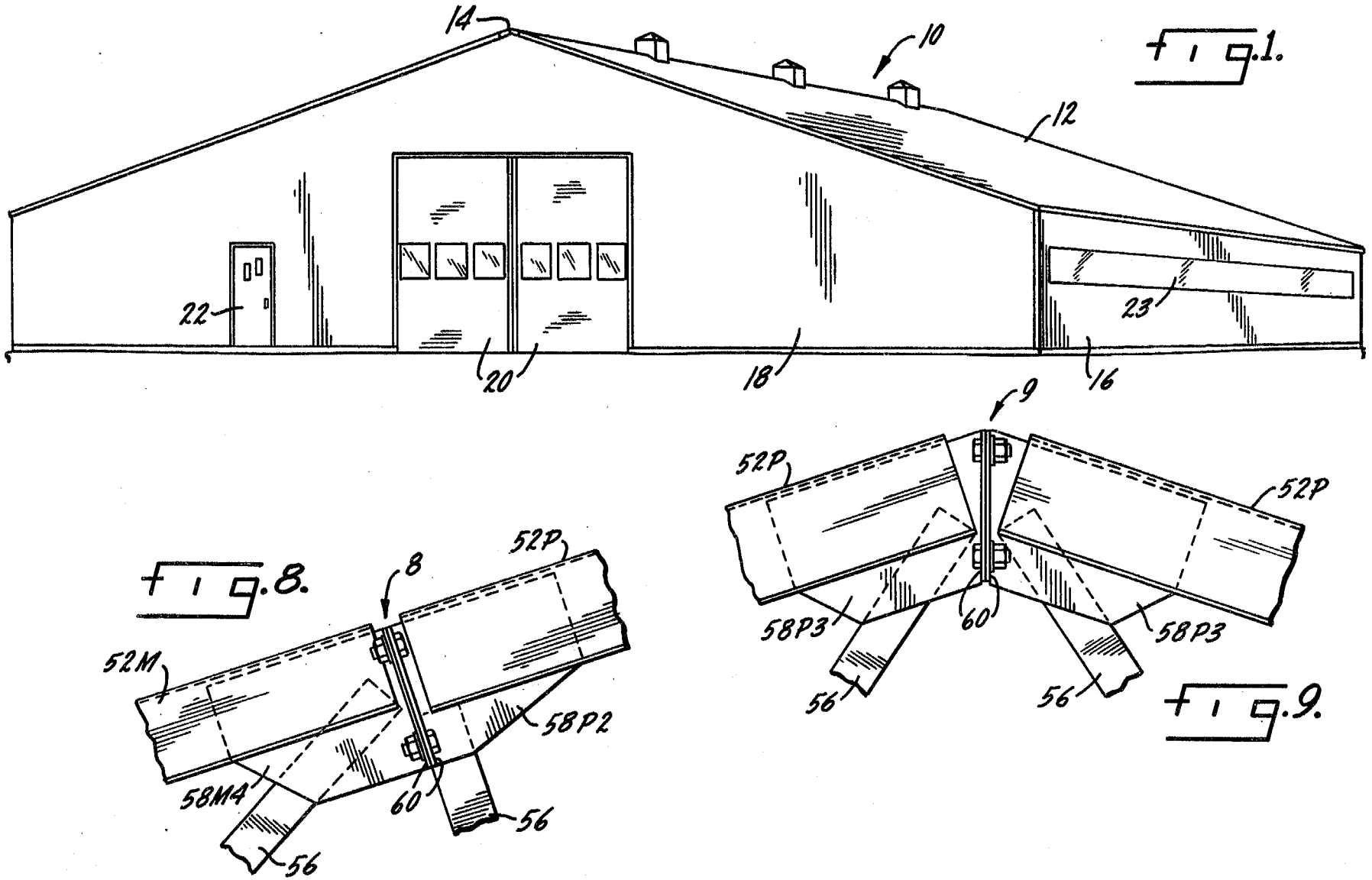
FIG. 1 is a perspective view of a completed building.
FIGS. 4 through 10 are detail elevation views of the connections between the individual truss units of the sub-frame of FIG. 3.

FIG. 1 shows a completed building 10 such as would result from use of the building frame construction of the present invention. Building 10 has a roof 12 which slopes downwardly from its peak 14 to the tops of the side walls 16. End walls 18 complete the building enclosure. The building walls may include suitable openings for service doors 20, personnel doors 22, and windows or translucent panels 23.

Figure 2:
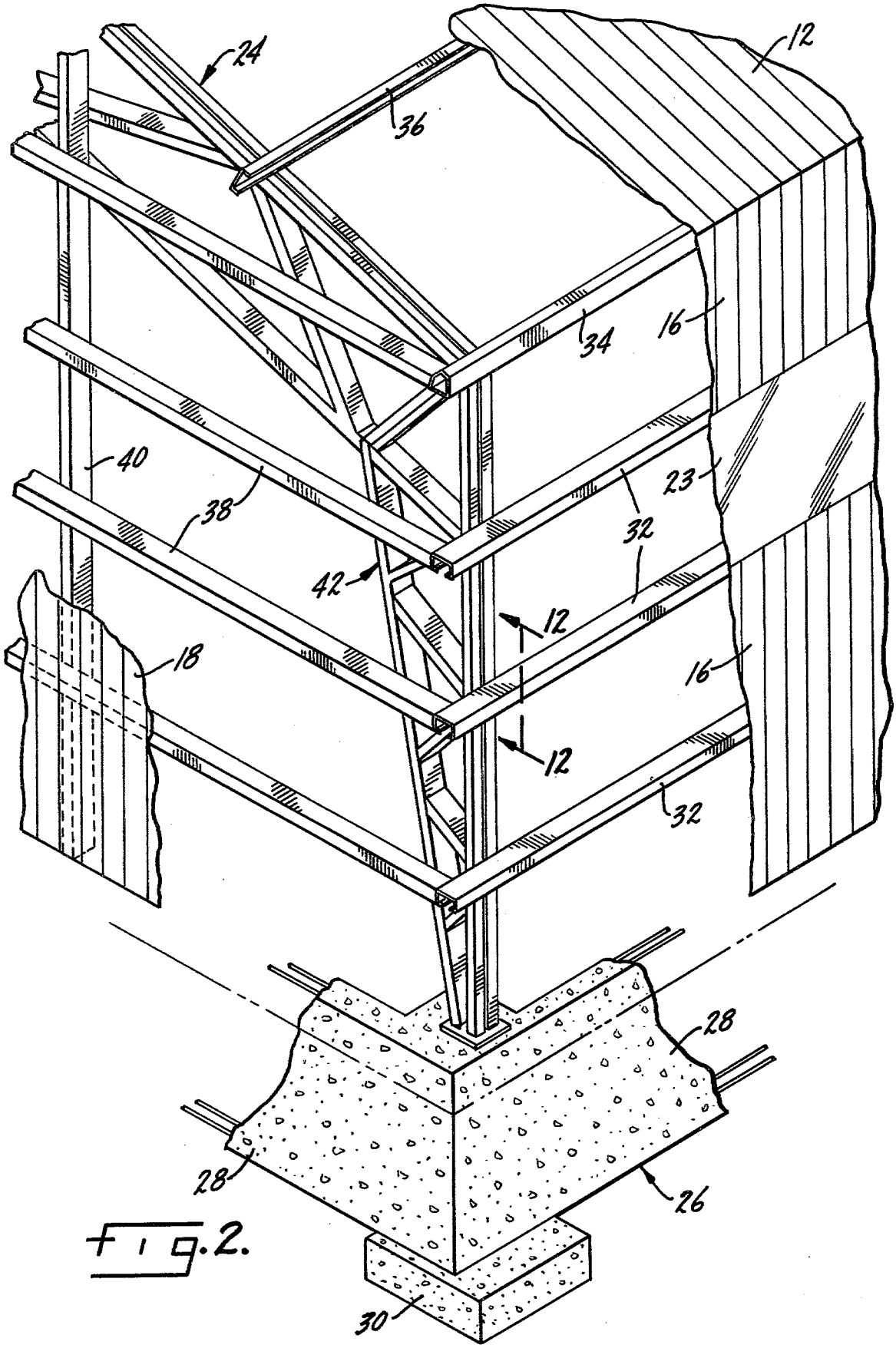
FIG. 2 is a perspective view of a corner of the building frame construction.

The frame construction itself is generally shown in FIG. 2. This view of a corner of the building frame includes a part of one sub-frame assembly 24. This assembly rests on a foundation 26. The foundation may be of the type having grade beams 28 and concrete footings 30, but it may also be a simple pier type foundation. The particular foundation structure is not critical and does not form a part of this invention.

A series of girts 32 in the form of channel sections are fastened to the sub-frame supports for the side wall panels 16 and, when present, translucent panels 23. An eave girt 34 comprised of a specially formed box channel is provided at the point where the side wall meets the roof of the building. A series of purlins 36 are connected along the top of the sub-frame to form the support for the roof panels 12. The end wall panels 18 are supported by a plurality of end wall girts 38 mounted on end wall columns 40. These end wall girts are also fastened to the sub-frame 24 at the building ends.

Figures 3, 4, 5, 6, 7:
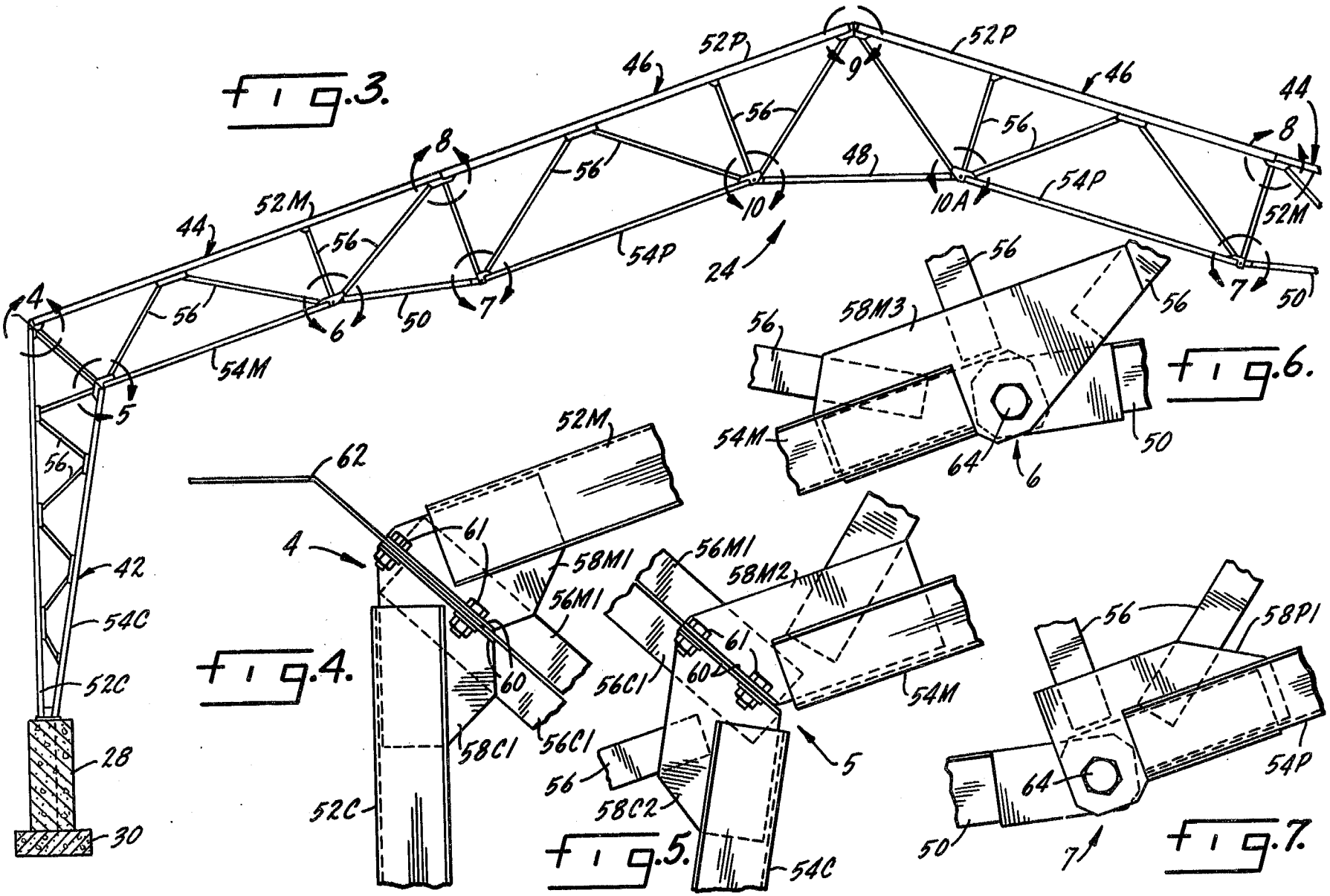
FIG. 3 is an elevation view of a sub-frame constituting a principal element of the building frame.

A partial elevation view of an assembled sub-frame 24 is shown in FIG. 3. The complete sub-frame consists of a pair of column truss units 42 (one shown), a pair of middle truss units 44, and a pair of peak truss units 46. The peak truss units 46 are connected to each other on the inside by an upper tie bar 48; they are connected to the middle truss units 44 by two tie bars 50. FIG. 3 does not show the right-hand side middle and column trusses. These units are the same as the left-hand middle and column truss units 44 and 42.

Each truss unit includes an outside main beam 52 and an inside main beam 54. The outer main beams are designated as 52C, 52M and 52P for the column truss 42, the middle truss 44 and the peak truss 46, respectively; similar designations 54C, 54M and 54P are used for the inner main beams. The main beams of each truss unit are interconnected by struts and braces 56 to form a complete modular unit. Looking at FIG. 3, the truss units 42, 44 and 46 are connected in the following manner. The column truss 42 and middle truss 44 are connected at points 4 and 5. The middle truss inside main beam 54M is connected to the inside main beam 54P of the peak truss by the bar 50 at connection points 6 and 7. The middle truss outside beam 52M is connected to the peak truss outside beam 52P at connection point 8. The peak of the building is at a connection point 9, joining the two main beams 52P where the left and right peak truss units 46 meet. The inside main beams 54P of the peak units do not meet but are connected by the upper tie bar 48, at the joints 10 and 10A.

The details of the truss joints are shown in FIGS. 4 through 10. The joint numbers 4–10 in FIG. 3 correspond to the numbers of the figures showing the details of each joint. Thus, FIG. 4 shows the connection 4 of the outside main beams 52C and 52M of the column and middle truss units. At the corner each truss unit has a gusset plate to which a cross brace is secured. Thus, the corner of the column truss unit includes a gusset plate 58C1 welded to beam 52C and to a brace 56C1; the corner of the middle truss unit includes a gusset plate 58M1 welded to beam 52M and to a brace 56M1. Each cross brace is a channel member which has attached to it a gusset plate with flanges constituting brackets 60 extending beyond each side of the channel to provide a bolting surface. The connection is then made by bolts 61 extending through both of the brackets 60 of the mating cross braces 56M1 and 56C1. In addition, an eave bracket 62 is bolted between these truss units to form a support for the eave girt 34 (see FIG. 2).

In FIG. 5 the construction is similar. The gusset plates 58C2 and 58M2 are welded to the inside main beams 54C and 54M and to the cross braces 56C1 and 56M1, with the brackets 60 extending at ninety degrees to the gusset plates. The connection is again made by bolts 61 through the brackets 60.

In FIGS. 6 and 7 the connections at the opposite ends of the lower left tie bar 50 are shown. As in the previous connections, there is a gusset plate 58M3 at the corner of the middle truss unit connected to tie bar 50 (FIG. 6) and a gusset plate 58P1 at the joint between the tie bar and the peak truss unit (FIG. 7). Unlike connections 4 and 5, however, connections 6 and 7 do not require extending brackets to provide a bolting surface. Rather, the bolts 64 for these tie bar connections fit directly through each of the pieces to form the connection.

Connections 8 and 9 (FIG. 3) are shown in detail in FIGS. 8 and 9. At these points the bracket and gusset plate type connection is again utilized with the brackets 60 affixed to the gusset plates 58M4 and 58P2 (FIG. 8) and 58P3 (FIG. 9).

Figure 10:
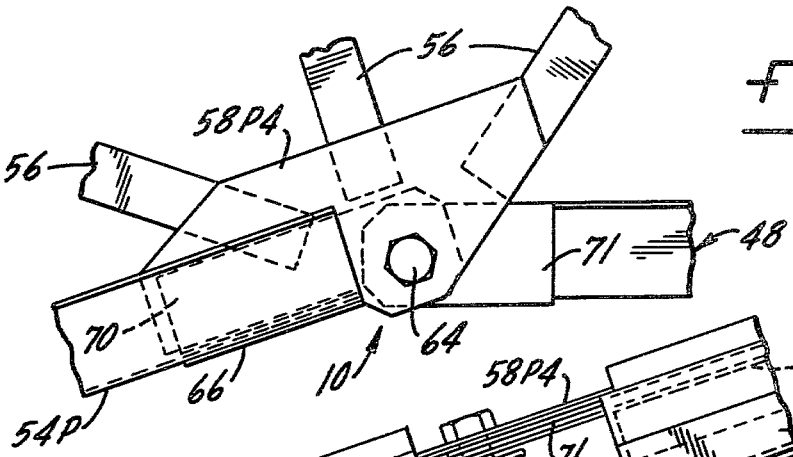
Figure 11:
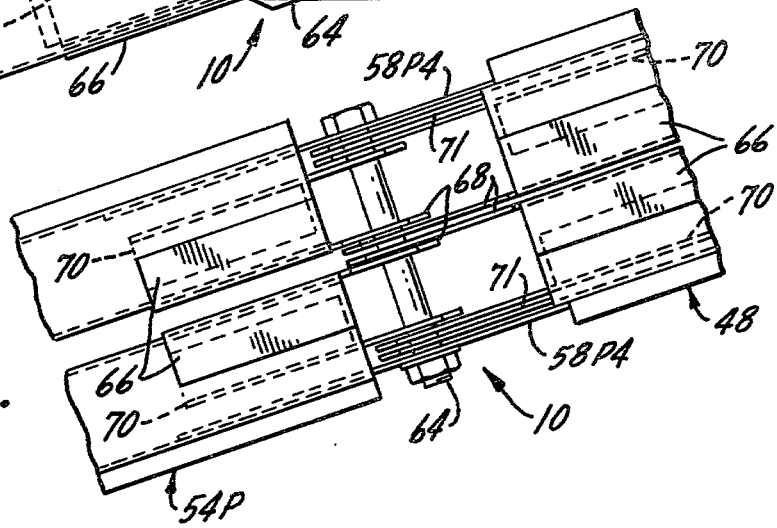
FIG. 11 is a bottom view of the truss connection shown in FIG. 10.

The upper tie bar connection is shown in FIGS. 10 and 11. As with the lower tie bar connections, this one is made by a single bolt 64 fitting directly through extensions in the inside main beams of the two peak truss units (one shown) and the tie bar or beam 48. As seen in FIG. 11, beam 54P and bar 48 each has a pair of top brackets 66 welded thereto with clips 68 extending beyond the end of the beam or bar to receive the bolt 64. There is also a pair of inside brackets 70, shown in dash lines, which also have clips extending for connection by the bolts. In addition, the beam and the tie bar each has a pair of plates welded to the inside thereof providing a further connection point. For the peak truss units these are the gusset plates 58P4 on the extreme outsides of the connection while for the tie bar they are the plates 71 on the inside of the joint.

Figure 12:
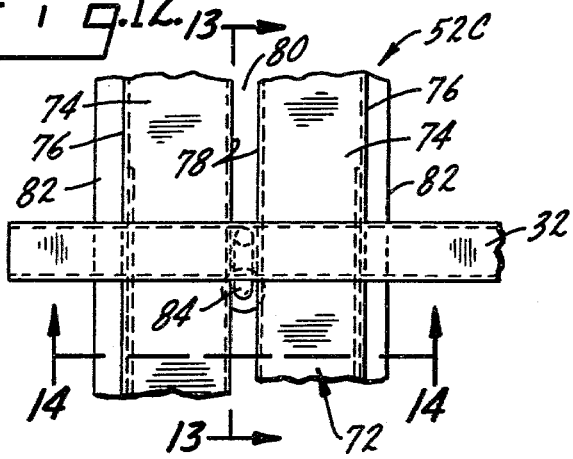
FIG. 12 is a detail elevation view of a main truss beam taken approximately along lines 12—12 in FIG. 2.
Figure 13:
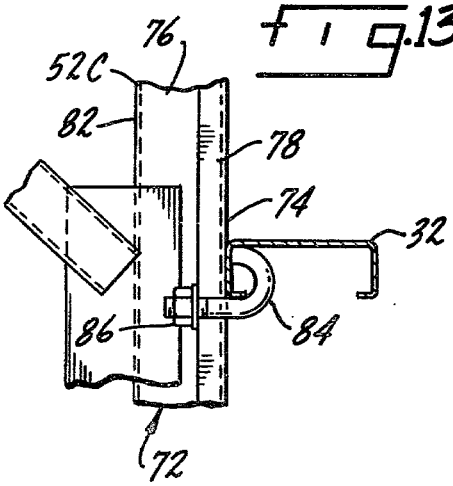
FIG. 13 is a detail section view of a main truss beam taken approximately along line 13—13 in FIG. 12.
Figure 14:
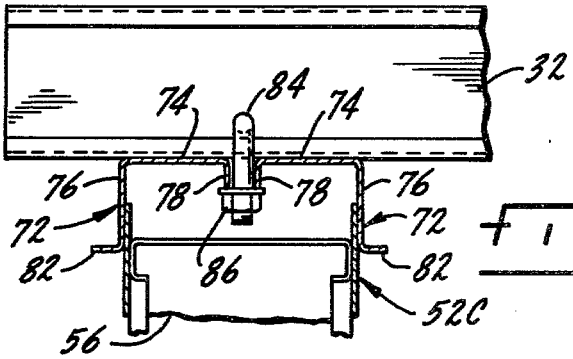
FIG. 14 is a detail section view of a main truss beam taken approximately along line 14—14 in FIG. 12.

The inside and outside main beams of each truss unit have a particular construction which allows infinitely adjustable placement of purlins and girts. This construction utilizes a slot down the middle of a generally box-shaped beam which permits the positioning of fasteners at any point therealong. This construction is best seen in FIGS. 11–14. The beam 52C consists of a pair of generally hook-shaped angle members 72. Each angle has a foot portion 74 and a leg portion 76. The edge of each foot portion 74 is bent at essentially a 90° angle to form a flange 78. These flanges 78 are in spaced facing relation, separated by a slot 80 (FIG. 12). The edges of the leg portions 76 can also be flanged as at 82 to lend extra rigidity. The two angle pieces 72 that constitute the beam 52C are held in place by the cross braces 56 of each unit (See FIG. 3). The braces 56 are channel sections, one side of which is welded to one of the angle members 72 (FIGS. 12–14), the other side being welded to the other angle member. The cross brace then extends to the other main beam where it is similarly attached. This construction provides a slot which runs the full length of the inside and outside main beams in each truss unit. A J-shaped bolt-type fastener 84 (FIGS. 12–14) can be inserted in the slot 80 to support a purlin or girt at any desired point along the beam. Since the inside portion of the main beam is generally open, access to the nut 86 for bolt-fastener 84 is readily available for tightening the fastener (FIGS. 13,14).

FIG. 12 shows how the girt 32 may be moved up and down the slot 80, thus making it possible to have any desired number of purlins (or girts) at any spacing required for the load conditions to which the building will be subjected.

It will be noted that the inside main beams of the truss unit and the tie bars also have this special slotted construction. This permits positioning of hangers or shelves on the inside of the building at any desired location.

We claim:

1. In a building frame of the type having a plurality of transverse sub-frames which form the roof support beams and side wall columns of the building, with girts and purlins interconnecting the sub-frames, and end wall columns and girts enclosing the building frame, each sub-frame comprising a plurality of interconnected truss units and each truss unit including an inner main beam and an outer main beam interconnected by a plurality of braces, the improvement comprising a main beam construction for the truss units which permits attachment of any number of purlins and girts at any point along the beam, each outer main beam comprising a pair of angle members each having integrally formed at the edge of at least one of its legs a flange extending substantially ninety degrees inwardly toward the opposite leg, the pair of angle members being aligned so that their flanges are in facing relation but are separated by a slot between the angle members, the slot running uninterruptedly the length of the outer main beam to provide an attachment point for a purlin or girt fastener at any point along its length;

and spacer means for holding the pair of angle members in their spaced facing relationship.

2. The truss unit main beam construction of claim 1 wherein the spacer means comprises channel-shaped brace members attached to the angle members with the two sides of the channel so connected to opposite angles as to maintain full accessibility to the slots.

3. In a building frame truss unit of the kind having inside and outside main beams interconnected by braces to form a unitary assembly, an improved construction for both main beams which permits attachment of girts, purlins, or other structural elements at any point along the beams, the improved beam construction comprising a pair of angle members each having integrally formed at the edge of at least one of its legs a flange extending at substantially ninety degrees inwardly toward the opposite leg, the pair of angle members being aligned so that their flanges are in facing relation but are separated by a slot between the angle members, the slot running uninterruptedly the length of the beam to provide an attachment point for a purlin, girt, or other structural fastener at any point along the beam length;

and spacer means for holding the pair of angle members in their spaced facing relationship.

4. The truss unit construction of claim 3 wherein the spacer means comprises a series of channel brace members each attached at one end to the two outside main beam angle members and at the other end to the two inside main beam angle members, the channel brace members thus maintaining the angle members in their spaced relationship while serving as braces for the truss unit.

* * * * *